US006874782B2

(12) United States Patent
Hall et al.

(10) Patent No.: US 6,874,782 B2
(45) Date of Patent: Apr. 5, 2005

(54) SORTER EXIT SENSOR

(75) Inventors: John H. Hall, Rochester, NY (US); Paul B. Stumpf, Rochester, NY (US); Anthony M. Olexy, Honeoye, NY (US)

(73) Assignee: Eastman Kodak Company, Rochester, NY (US)

( * ) Notice: Subject to any disclaimer, the term of this patent is extended or adjusted under 35 U.S.C. 154(b) by 119 days.

(21) Appl. No.: 10/301,073

(22) Filed: Nov. 21, 2002

(65) Prior Publication Data

US 2004/0100019 A1 May 27, 2004

(51) Int. Cl.[7] ..... B65H 29/00
(52) U.S. Cl. ..... 271/279
(58) Field of Search ..... 271/279

(56) References Cited

U.S. PATENT DOCUMENTS 3,815,897 A * 6/1974 Hoehl et al. ..... 271/9.13
4,919,027 A * 4/1990 Littleton ..... 83/107
5,580,045 A * 12/1996 Matsumoto et al. ..... 271/298
6,325,371 B1 12/2001 Araki et al.

FOREIGN PATENT DOCUMENTS

JP 54-124364 4/1981
JP 60-035163 8/1986
JP 08-247677 4/1998
JP 2000-072323 3/2000

* cited by examiner

*Primary Examiner*—Donald F. Walsh
*Assistant Examiner*—Kenneth W Bower
(74) *Attorney, Agent, or Firm*—William F. Noval

(57) ABSTRACT

A sheet detection system comprising: a first sheet transport for transporting a sheet along a first sheet transport path; at least second and third sheet transports for selectively transporting a sheet transported along the first sheet transport path along second and third spaced and substantially parallel sheet transport paths which branch from the first sheet transport path; a radiation source for emitting a beam of radiation which intersects the second and third sheet transport paths in the region where the second and third paths branch from the first path; a radiation detector for detecting the radiation beam; and a control for controlling the first, second and third sheet transports the radiation source and the radiation detector, such that when a sheet which is transported along the first sheet transport path by the first sheet transport is caused to be transported along one of the second or third transport paths, interruption or lack of interruption of the radiation beam by the sheet is detected by the radiation detector to indicate whether the sheet has or has not been transported along the one path.

11 Claims, 3 Drawing Sheets

SORTER EXIT SENSOR

FIELD OF THE INVENTION

This invention relates in general to the handling of sheet material and, more particularly, to detecting the position of a sheet within a sheet handling device.

BACKGROUND OF THE INVENTION

Sheet handling devices are widely used in image reproduction systems such as analog and digital copiers and radiographic laser printers. In such devices, sequential sheets are output to one or more output bins. In the case of multiple output bins, such as sorters, the sheets are selectively deflected from a main sheet transport path into secondary sheet transport paths which branch off the main sheet transport path. In order to detect sheet jamming in one of the sheet transport paths, sheet sensors are located along the sheet transport paths to detect the presence or absence of a sheet. Typically, individual sensors are located along the main path and along each secondary path. The use of several sensors adds expense and complexity to the sorter control system. Japanese Patent Application no. 60-035163, publication date Aug. 28, 1986, inv. Michio, Japanese Patent Application no. 2000-072323, publication date Mar. 7, 2000, inv. Tomoyuki et al., Japanese Application no. 08-247677 and U.S. Pat. No. 6,325,371B, filed Aug. 31, 1999, inv. Araki et al., disclose sorters having sheet sensors which do not solve this problem.

Japanese Patent Application no. 54-124364, publication date, Apr. 28, 1981, inv. Yotaro et al. discloses a sorter having a single light source, light detector positioned to determine whether any of the sorter bins contain sheets. Once a sheet has entered any bin, the sensor is disabled and cannot detect sheet jams.

There is thus a need for a simple and inexpensive sheet detection system for a sorter that can detect sheet jams in the main sheet path and secondary sheet paths to the output bins.

SUMMARY OF THE INVENTION

According to the present invention, there is provided a solution to the problems and fulfillment of the needs discussed above.

According to a feature of the present invention, there is provided a sheet detection system comprising:

a first sheet transport for transporting a sheet along a first sheet transport path;

at least second and third sheet transports for selectively transporting a sheet transported along said first sheet transport path along second and third spaced and substantially parallel sheet transport paths which branch from said first sheet transport path;

a radiation source for emitting a beam of radiation which intersects said second and third sheet transport paths in the region where said second and third paths branch from said first path;

a radiation detector for detecting said radiation beam; and a control for controlling said first, second and third sheet transports said radiation source and said radiation detector, such that when a sheet which is transported along said first sheet transport path by said first sheet transport is caused to be transported along one of said second or third transport paths, interruption or lack of interruption of said radiation beam by said sheet is detected by said radiation detector to indicate whether said sheet has or has not been transported along said one path.

ADVANTAGEOUS EFFECT OF THE INVENTION

The invention has the following advantages.

1. The sorter sensor system is simple and inexpensive.

2. A single radiation source/radiation sensor is used to monitor the movement of sheet to many outputs.

DETAILED DESCRIPTION OF THE INVENTION

In general, the present invention is applicable to sheet handling devices which have a number of sheet transport paths either branching from a common path to sorting bins, such as in a sorter used with the output of image reproduction apparatus (radiographic laser printers) or from a number of sources of sheet media which merge into a single sheet transport path, such as sheet media supply stations used at the input to image reproduction apparatus. In the following description, there will be described a sheet sensing system used in a sheet sorter system.

Figure 1:
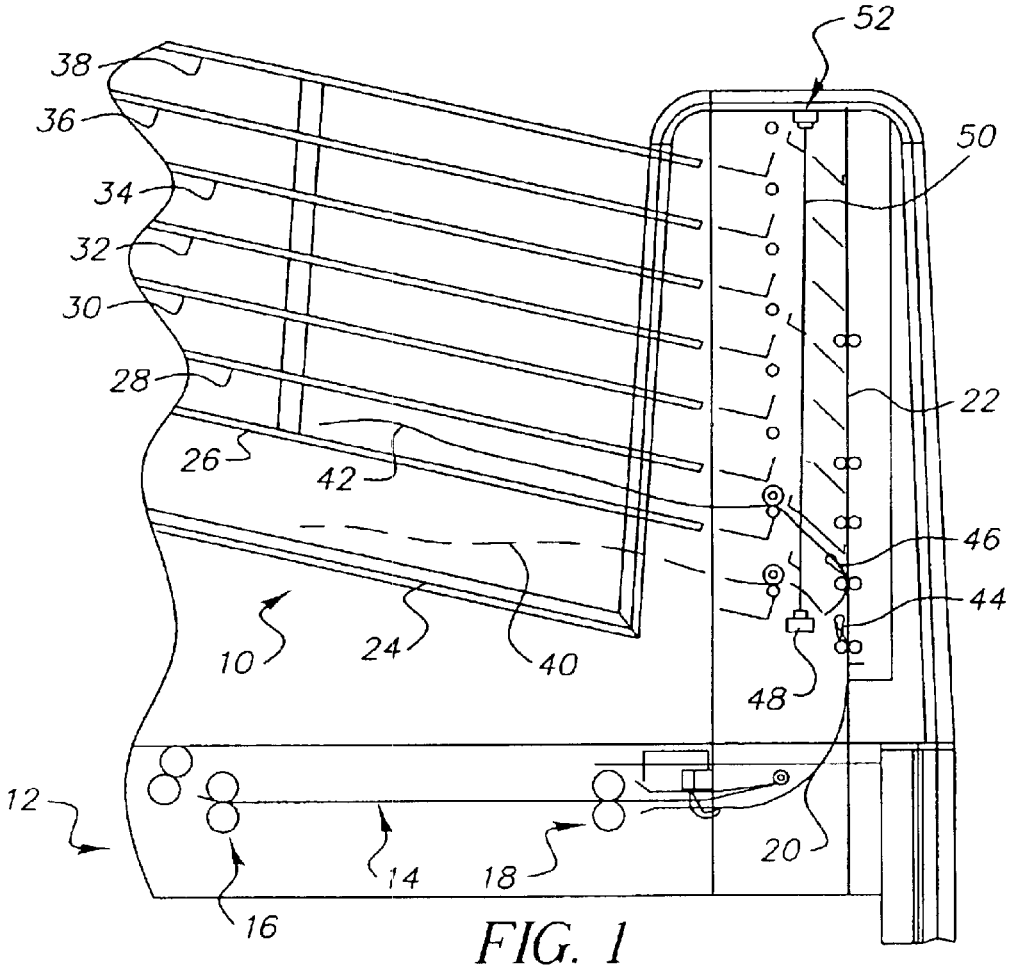
FIG. 1 is an elevational diagrammatic view of an embodiment of the present invention.

Referring now to FIG. 1, there is shown a sheet sorter located at the output of a sheet utilization apparatus, such as a radiographic laser printer. The sorter 10 is mounted on the top of apparatus 12 which produces a sheet along apparatus sheet transport path 14 including sheet transport roller pairs 16 and 18. Sheet deflector 20 deflects a sheet from path 14 into first sheet transport path 22 of sorter 10. Sorter 10 includes a number of parallel sheet sorting bins 24, 26, 28, 30, 32, 34, 36 and 38. A plurality of selectable sheet transport paths, 40, 42, etc., branch from first sheet transport path 22 to bins 24, 26, etc. Selectively actuated sheet deflectors 44, 46 are located adjacent to path 22 to deflect a sheet into a selected bin 24–38. As shown, deflector 44 is in an inactive state out of path 22, while deflector 46 has been activated to move into path 22 thus establishing a continuous sheet transport path from path 22 to path 42 and into bin 26.

According to the present invention, sheet detection system includes a radiation (light) source 48 which emits a beam of radiation 50 which is detected by radiation detector 52. In this example, radiation beam 50 is substantially parallel to sheet transport path 22 and intersects sheet transport paths 40, 42, etc., substantially perpendicular to paths 40, 42, etc. in the region where such paths branch from path 22. Sheets transported along paths 40, 42, etc., cannot be completely transparent to radiation from source 48 since the presence or absence of a sheet along a path is detected by the radiation blocking effect of a sheet.

Figure 4:
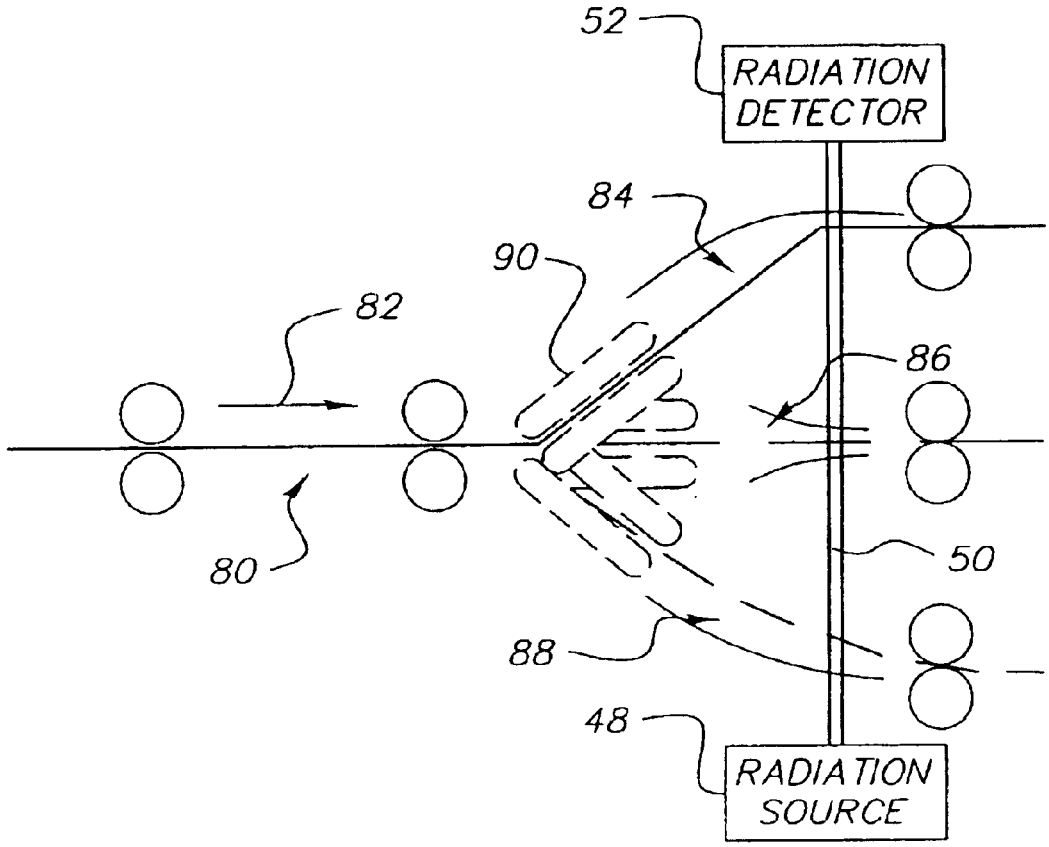
FIG. 4 is an elevational diagrammatic view of another embodiment of the present invention.

It is to be understood that radiation beam 50 need not be parallel to the first transport path. As shown in FIG. 4, a sheet is transported along path 80 in the direction of arrow 82. Deflector 90 is selectively actuated to deflect the sheet along paths 84, 86, and 88 which branch off from path 80. Radiation source 48 directs beam 50 to radiation detector 52.

Figure 2:
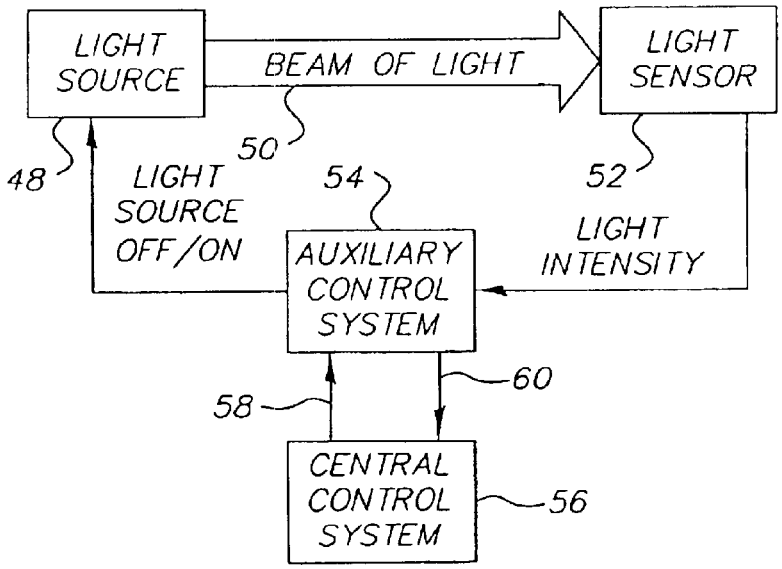
FIG. 2 is a block diagram of a control system for the present invention.

Referring now to FIG. 2, there is shown a block diagram of a control system for the present invention. As shown, auxiliary control system 54 controls source 48 to turn source 48 on and off. The light (radiation) intensity detected by sensor 52 indicates the presence or absence of a sheet.

The sheet detection system of the invention can detect whether a sheet is delivered successfully to a branched sheet transport path or not. As shown in FIG. 2, central control system 56 sends a "sheet is coming" signal 58 to auxiliary control system 54. Knowing when a sheet enters the sheet transport paths and how long it should take to deliver the sheet to its destination, control system 54 can calculate the time at which the leading and/or trailing edge of the sheet will intersect the beam of light. If the light detector 52 shows that the edges(s) do indeed pass through the light beam 50 at that/those times, the sheet has reached its destination safely. If not, a problem of some kind such as a jam, has occurred. System 54 sends either a "successful" or "failure" signal 60 to system 56 as a result.

Figure 3:
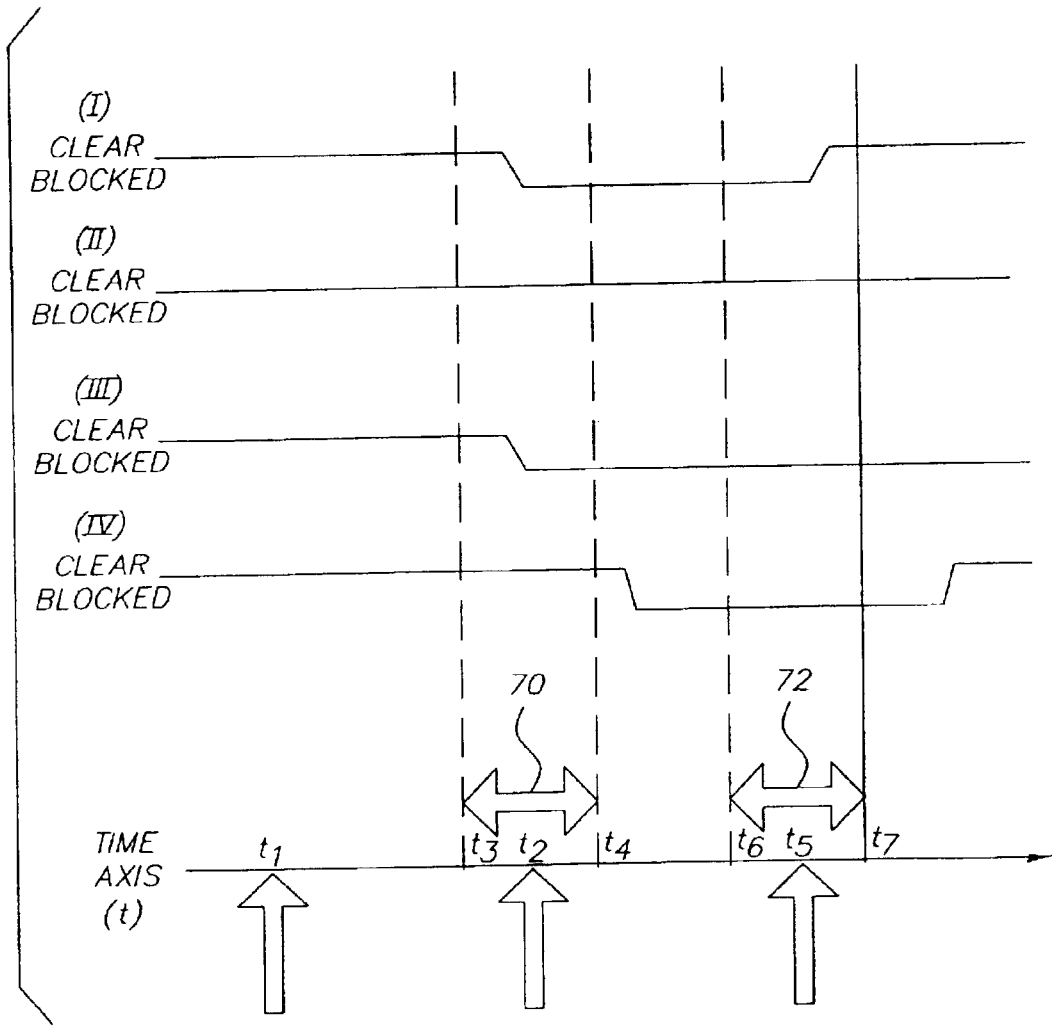
FIG. 3 is a timing diagram useful in explaining the present invention.

Referring now to FIG. 3 (and also FIG. 2), there is shown timing signal diagrams useful in explaining the invention. As shown, along the time axis t is a time $t_1$, when control system 54 receives a signal indicating a sheet is on the way to a specified exit. This allows control system 54 to compute a nominal time $t_2$ at which the leading edge of a sheet is calculated to pass through the beam of light 50 and a nominal time $t_5$ at which the trailing edge of a sheet is calculated to pass through the beam of light 50. A leading edge window 70 between times $t_3$ and $t_4$ bracketing time $t_2$, and a trailing edge window 72 between times $t_6$ and $t_7$ bracketing time $t_5$, are sized to account for expected mechanical and sheet size variation.

Timing diagram I of FIG. 3 is an example of light sensor output when a sheet is successfully delivered to a selected branch sheet path. Timing diagram II of FIG. 3 is an example of light sensor output when a sheet never reaches the light sensor. Timing diagram III of FIG. 3 is an example of light sensor output when a sheet jams while it is passing the sensor. Timing diagram IV of FIG. 3 is an example of light sensor output when a sheet arrives at the sensor late.

By positioning the beam of light very close to the sheet exits, there is little or no chance that a failure could occur after the trailing edge of the sheet passed through the light beam.

The control system can calibrate the system by reading the light sensor output when the beam is unobstructed, both with the light source on and with the light source off. It will than compute a threshold value somewhere between those two readings. Any time the light detector reports a level less than that threshold, a sheet is intersecting the beam. This calibration procedure will compensate for changes in the intensity of the light source, changes in the sensitivity of the light detector, changes to the geometry of the optical path, and variations in ambient light.

The light source 48 can be any device that emits light of any spectrum. Some such devices are incandescent bulbs and light emitting diodes.

The light sensor 52 can be any device that can detect the intensity of the light source. Photocells, phototransistors, and photomultiplier tubes are examples of devices that could be used.

The control systems 54, 56 could be implemented with discrete electronics, programmed logic devices, a microcomputer, or other programmable things.

The invention has been described in detail with particular reference to certain preferred embodiments thereof, but it will be understood that variations and modifications can be effected within the spirit and scope of the invention.

Parts List

10 sorter
12 apparatus
14 sheet transport path
16,18 rollers
20 sheet deflector
22 first sheet transport path
24 parallel sheet sorting bin
26 parallel sheet sorting bin
28 parallel sheet sorting bin
30 parallel sheet sorting bin
32 parallel sheet sorting bin
34 parallel sheet sorting bin
36 parallel sheet sorting bin
38 parallel sheet sorting bin
40,42 selectable sheet transport paths
44 sheet deflector
46 sheet deflector
48 radiation light source
50 beam of radiation
52 radiation detector
54 auxiliary control system
56 central control system
58 signal
60 signal
70 leading window edge
72 trailing edge window
80 path
82 direction arrow
84 path
86 path
88 path
90 deflector

What is claimed is:

1. A sheet detection system comprising:

a first sheet transport for transporting a sheet along a first sheet transport path;

at least second and third sheet transports for selectively transporting a sheet transported along said first sheet transport path along second and third spaced and substantially parallel sheet transport paths which branch from said first sheet transport path;

a radiation source for emitting a beam of radiation directed toward and which intersects with said second and third sheet transport paths in the region where said second and third paths branch from said first path;

a radiation detector for detecting said radiation beam, the radiation detector being spaced from the radiation source such that the second and third transport paths are intermediate the radiation source and radiation detector; and a control for controlling said first, second and third sheet transports, said radiation source and said radiation detector, such that when a sheet which is transported along said first sheet transport path by said first sheet transport is caused to be transported along one of said second or third transport paths, interruption or lack of interruption of said radiation beam by each individual sheet is detected by said radiation detector to indicate whether each individual sheet has or has not been transported along said one path.

2. The system of claim 1 wherein said radiation source emits a beam of radiation in a direction which is substantially parallel to said first sheet transport path.

3. The system of claim 1 including sheet collecting bins located along said second and third sheet transport paths beyond said region of intersection of said radiation beam with said paths.

4. The system of claim 1 wherein said sheets which are transported along said first, second, and third paths are not completely transparent to said radiation of said radiation beam so that interruption of said radiation beam by a sheet reduces the amount of radiation detected by said radiation detector thus alerting said control to the presence of said sheet.

5. The system of claim 1 wherein said control determines whether or not a sheet has interrupted said beam of radiation within a predetermined time interval in order to determine whether or not said sheet has successfully been transported along said paths.

6. The system of claim 1 wherein said control calibrates said radiation source and said radiation detector by determining the output level of said radiation sensor both when said radiation source emits said beam of radiation and when said radiation sensor does not emit said beam of radiation and by calculating a threshold level from said output levels, said threshold level being used to determine whether or not a sheet is interrupting said radiation beam.

7. A sheet detection system comprising:

a first sheet transport for transporting a sheet along a first sheet transport path;

at least second and third sheet transports for selectively transporting a sheet transported along said first sheet transport path along second and third spaced and substantially parallel sheet transport paths which branch from said first sheet transport path;

a radiation source for emitting a beam of radiation directed toward and which intersects with said second and third sheet transport paths in the region where said second and third paths branch from said first path;

a radiation detector for detecting said radiation beam, the radiation detector being spaced from the radiation source such that the second and third transport paths are intermediate the radiation source and radiation detector; and a control for controlling said first, second and third sheet transports said radiation source and said radiation detector, such that when a sheet which is transported along said first sheet transport path by said first sheet transport is caused to be transported along one of said second or third transport paths, interruption or lack of interruption of said radiation beam by said sheet is detected by said radiation detector to indicate whether said sheet has or has not been transported along said one path, said control calibrates said radiation source and said radiation detector by determining the output level of said radiation sensor both when said radiation source emits said beam of radiation and when said radiation sensor does not emit said beam of radiation and by calculating a threshold level from said output levels, said threshold level being used to determine whether or not a sheet is interrupting said radiation beam.

8. The system of claim 7 wherein said radiation source emits a beam of radiation in a direction which is substantially parallel to said first sheet transport path.

9. The system of claim 7 including sheet collecting bins located along said second and third sheet transport paths beyond said region of intersection of said radiation beam with said paths.

10. The system of claim 7 wherein said sheets which are transported along said first, second, and third paths are not completely transparent to said radiation of said radiation beam so that interruption of said radiation beam by a sheet reduces the amount of radiation detected by said radiation detector thus alerting said control to the presence of said sheet.

11. The system of claim 7 wherein said control determines whether or not a sheet has interrupted said beam of radiation within a predetermined time interval in order to determine whether or not said sheet has successfully been transported along said paths.

* * * * *